US010211582B1

(12) United States Patent
Orris et al.

(10) Patent No.: US 10,211,582 B1
(45) Date of Patent: Feb. 19, 2019

(54) BUS BAR CLAMP

(71) Applicant: TE CONNECTIVITY CORPORATION, Berwyn, PA (US)

(72) Inventors: David Patrick Orris, Middletown, PA (US); John Joseph Consoli, Harrisburg, PA (US); Brian Patrick Costello, Scotts Valley, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/961,150

(22) Filed: Apr. 24, 2018

Related U.S. Application Data

(60) Provisional application No. 62/543,673, filed on Aug. 10, 2017.

(51) Int. Cl.
*H01R 25/16* (2006.01)

(52) U.S. Cl.
CPC ..... *H01R 25/162* (2013.01); *H01R 25/164* (2013.01)

(58) Field of Classification Search
CPC ... H01R 13/703; H01R 25/162; H01R 25/164
See application file for complete search history.

(56) References Cited

U.S. PATENT DOCUMENTS 5,321,221 A * 6/1994 Rozier ..... H01H 1/5833 218/2
6,178,106 B1 * 1/2001 Umemoto ..... H01R 11/12 363/146
2008/0096416 A1 * 4/2008 Wedler ..... H01R 9/03 439/389
2009/0239399 A1 * 9/2009 Azzola ..... H01H 71/08 439/119
2010/0127816 A1 * 5/2010 Hofmann ..... H01H 71/1081 337/70

* cited by examiner

*Primary Examiner* — Briggitte R Hammond

(57) ABSTRACT

An electrical power distribution system includes a first bus bar and a clamp mounted to the first bus bar. The clamp includes a fixed base and a movable plate that define a track therebetween along a broad face of the first bus bar. The track receives a second bus bar therein such that the broad face of the first bus bar engages a corresponding broad face of the second bus bar. The clamp includes a lever connected to both the movable plate and the first bus bar. Pivoting movement of the lever in a locking direction forces linear movement of the movable plate relative to the first bus bar towards the fixed base such that respective inner sides of the movable plate and the fixed base sandwich the second bus bar therebetween to secure the second bus bar in engagement with the first bus bar.

20 Claims, 7 Drawing Sheets

BUS BAR CLAMP

CROSS-REFERENCE TO RELATED APPLICATIONS

This application claims benefit to U.S. Provisional Application No. 62/543,673, which was filed Aug. 10, 2017 and is titled Bus Bar Clamp. The subject matter of which is herein incorporated by reference in its entirety.

BACKGROUND

The subject matter herein relates generally to electrical connector systems that are used for electrically connecting a bus bar to another bus bar or to a cable, and, more specifically, to a bus bar clamp that can be used in an electrical power distribution system, such as a server rack.

Electrical server racks may include multiple trays of at least one server on each tray that are stacked within a section of the rack. The rack may include one or two power module trays and multiple server trays. Each power module tray is configured to distribute electrical power (e.g., current) to the server trays via a bus bar assembly mounted within the rack. For example, the power module receives power from a power source, converts the power to direct current (DC), and distributes the DC power to the server trays along the bus bar assembly. The bus bar assembly includes at least one primary or main bus bar which extends across multiple server trays. Each power module tray includes at least two branches or connecting bars that extend between the power module tray and the bus bar in order to deliver power to the bus bar.

Conventionally, when a tray, such as a power module tray or a server tray, is loaded into the rack in a certain position, the branch bar extending from that tray is permanently affixed to a main bus bar in the rack. For example, the branch bar may be aligned with the main bus bar to overlap a portion of the main bus bar, and the two bars may be permanently connected to each other along the overlapping area. The two bars may be permanently connected by installing fasteners, such as bolts or rivets, through both of the bars within the overlapping area, or by welding or soldering the bars together. Such permanent connections may satisfy the requirement for providing an electrically conductive path that can provide electrical power between the corresponding tray and the main bus bar, but are not modifiable. For example, once the branch bar of a power module tray is affixed to the main bus bar within the rack, the tray cannot be moved to a different position within the rack. If there is a desire to rearrange the position of the power module tray in the rack, such as to move the power module tray from a top position of the rack to a bottom position or a middle position within the rack, then the entire bus bar assembly of the rack may have to be replaced, and a new network of bus bars has to be assembled.

A need remains for a bus bar clamp that allows removable connection to a main bus bar in a bus bar assembly that does not damage the main bus bar and provides sufficient mating forces on the mating bars to enable low contact resistance at the mating interface.

SUMMARY

In one or more embodiments of the present disclosure, an electrical power distribution system is provided that includes a first bus bar and a clamp mounted to the first bus bar. The first bus bar has a broad face. The clamp includes a fixed base and a movable plate that define a track along the broad face between an inner side of the fixed base and an inner side of the movable plate. The track is configured to receive a second bus bar therein such that the broad face of the first bus bar engages a corresponding broad face of the second bus bar. The clamp includes a lever connected to both the movable plate and the first bus bar. Pivoting movement of the lever in a locking direction forces linear movement of the movable plate relative to the first bus bar towards the fixed base such that the inner sides of the movable plate and the fixed base sandwich the second bus bar therebetween to secure the second bus bar in engagement with the first bus bar.

In one or more embodiments of the present disclosure, an electrical power distribution system is provided that includes a first bus bar, a clamp mounted to the first bus bar, and a second bus bar. The first bus bar has a broad face. The clamp includes a fixed base and a movable plate that define a track along the broad face between an inner side of the fixed base and an inner side of the movable plate. The clamp includes a lever connected to both the movable plate and the first bus bar. The second bus bar has a broad face and first and second edge sides extending from the broad face. The second bus bar is received in the track with the broad face thereof engaging the broad face of the first bus bar at an interface. Pivoting movement of the lever in a locking direction forces linear movement of the movable plate relative to the first bus bar towards the second bus bar in the track such that the inner side of the movable plate engages the first edge side of the second bus bar and the inner side of the fixed base engages the second edge side of the second bus bar to secure the second bus bar in engagement with the first bus bar at the interface.

In one or more embodiments of the present disclosure, an electrical power distribution system is provided that includes a first bus bar and a clamp mounted to the first bus bar. The first bus bar has a broad face and defines linear guide slots therethrough that extend parallel to one another. The clamp includes a fixed base and a movable plate that are electrically conductive. The movable plate includes pins that extend into the guide slots. The fixed base and the movable plate define a track along the broad face between an inner side of the fixed base and an inner side of the movable plate. The track is configured to receive a second bus bar therein such that the broad face of the first bus bar engages a corresponding broad face of the second bus bar. The clamp includes a lever connected to both the movable plate and the first bus bar. Pivoting movement of the lever in a locking direction forces linear movement of the movable plate towards the fixed base guided by the pins within the guide slots. The linear movement of the movable plate causes the inner sides of the movable plate and the fixed base to engage respective first and second edge sides of the second bus bar to secure the broad face of the second bus bar in engagement with the broad face of the first bus bar. The fixed base and the movable plate provide respective electrically conductive paths between the first and second edge sides of the second bus bar and the first bus bar.

DETAILED DESCRIPTION

Embodiments of the present disclosure provide a bus bar clamp that allows for efficient, reliable, non-damaging, and non-permanent electrical connections between a main bus bar and a branch bus bar. For example, the bus bar clamp is selectively actuated between a closed, clamping position and an open, non-clamping position. The bus bar clamp allows a tray associated with a branch bus bar that is connected to the main bus bar to be disconnected and moved relative to the main bus bar, either to another position in the same server rack or to a different server rack, without modifying the main bus bar. In addition, the bus bar clamp does not deform or damage the main bus bar. Therefore, after disconnecting a first branch bus bar and removing the associated tray from the rack, a second branch bus bar can be connected to the same area of the main bus bar, without the risk of an increased contact resistance at the mating interface caused by damage or deformation along the main bus bar. In addition, the bus bar clamp is configured to provide engagement along at least three different surfaces of the main bus bar, which may allow for reduced electrical contact resistance between the main bus bar and the branch bus bar. This reduced electrical contact resistance at the mating interface may also reduce heat generation within the server rack, resulting in more efficient operation and less energy required for cooling.

Figure 1:
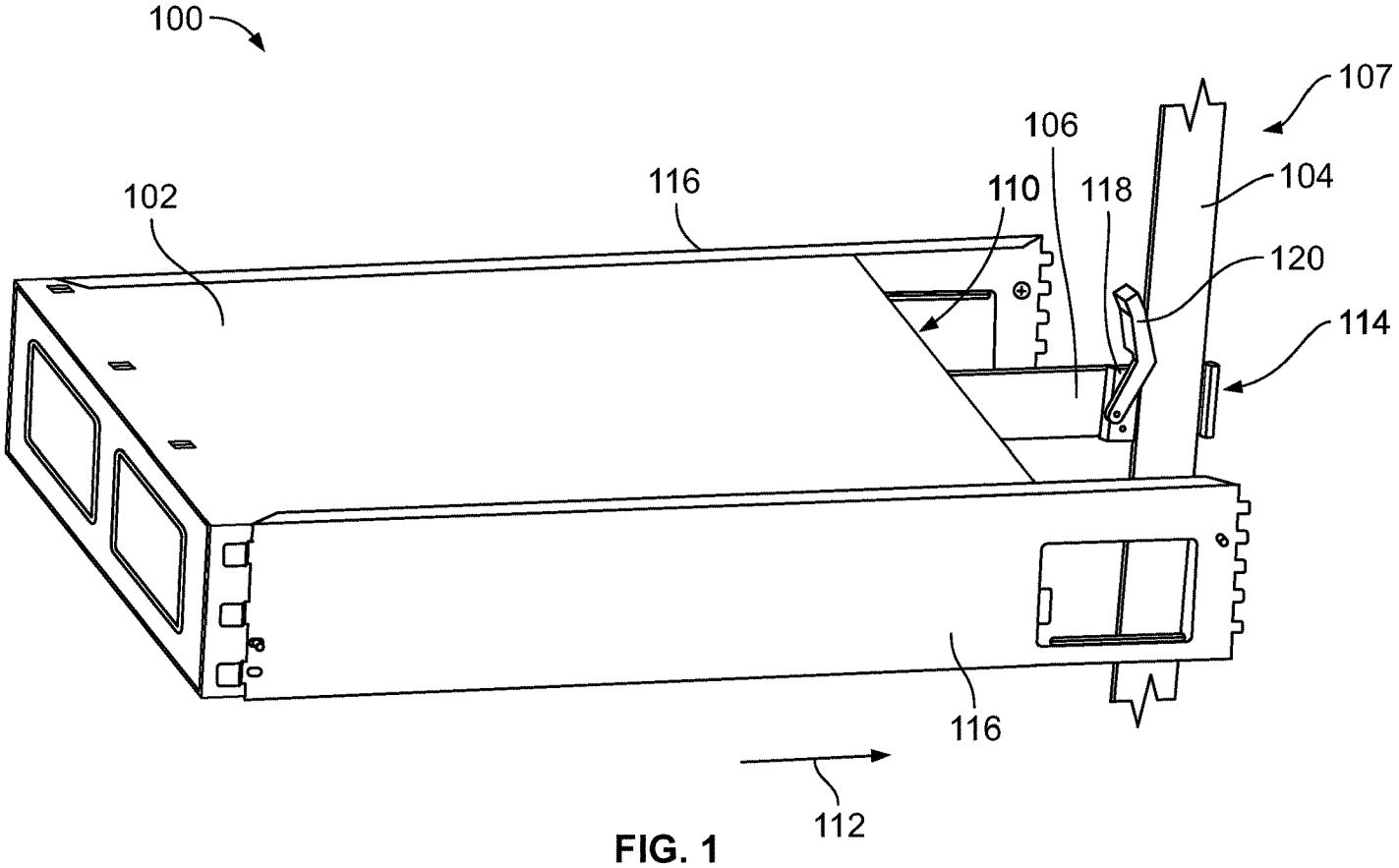
FIG. 1 is a top perspective view of a portion of an electrical power distribution system formed in accordance with an embodiment.

FIG. 1 is a top perspective view of a portion of an electrical power distribution system 100 formed in accordance with an embodiment. The illustrated portion of the power distribution system 100 includes a tray 102, a first bus bar 106, and a second bus bar 104. The first bus bar 106 is referred to herein as a branch bus bar 106, and the second bus bar 104 is referred to as a main bus bar 104. Although not shown, the power distribution system 100 may also include additional trays 102 that are stacked together within a rack. The tray 102 may be a server tray that includes at least one server or a power module tray that is configured to supply electrical power to server trays in the rack. For example, the power module tray may convert alternating current (AC) received from a power source to DC power that is transmitted to the server trays via the main bus bar 104. The main bus bar 104 and the branch bus bar 106 represent portions of a bus bar assembly 107 that may include additional bus bars. For example, the illustrated main bus bar 104 may be used for power distribution and a second main bus bar (not shown) that is parallel to the main bus bar 104 may be used for power return.

The main bus bar 104 may extend across multiple trays 102 in the rack. For example, in the illustrated embodiment the main bus bar 104 extends generally vertically. Although only one tray 102 is shown, other trays 102 may be stacked vertically above and/or below the illustrated tray 102 within the server rack. The main bus bar 104 is configured to convey electrical power among the trays 102 in the rack. In an embodiment, each of the trays 102 (e.g., including both power module trays and server trays) is secured to a respective branch bus bar 106 that is associated with that tray 102. For example, the branch bus bar 106 may be permanently or semi-permanently fixed to a back end 110 of the tray 102. The branch bus bar 106 extends generally horizontally from the back end 110. In an alternative embodiment, the rack may be oriented horizontally. For example, the trays 102 may be stacked horizontally, and the main bus bar 104 extends generally horizontally across the trays 102 either above or below the stack.

The server rack is assembled by loading the trays 102 into a rack frame in a rearward loading direction 112, which is parallel to the horizontal orientation of the branch bus bar 106. The main bus bar 104 is mounted in a rear zone of the server rack, so the tray 102 and the associated branch bus bar 106 move towards the main bus bar 104 as the tray 102 is loaded into the rack frame. As the tray 102 is moved farther in the loading direction 112, a rear end 114 of the branch bus bar 106 intersects and overlaps the main bus bar 104. Once the tray 102 reaches a fully loaded position within the server rack, sides 116 of the tray 102 are bolted to the rack frame to secure the tray 102 within the server rack.

The electrical power distribution system 100 includes a bus bar clamp 118 mounted on the branch bus bar 106. The bus bar clamp 118, referred to herein as clamp 118, is configured to releasably mechanically secure the branch bus bar 106 to the main bus bar 104 to electrically connect the two bus bars 104, 106. The clamp 118 is manually actuated between a closed position that locks the two bus bars 104, 106 together and an open position that allows the main bus bar 104 to be received within and removed from the clamp 118. In an embodiment, the clamp 118 is set to the open position as the tray 102 is loaded into the server rack, and the main bus bar 104 is received within the clamp 118 when the tray 102 reaches the fully loaded position. To close the clamp 118 and establish the connection between the bus bars 104, 106, a lever 120 of the clamp 118 is pivoted by a human operator or a robotic machine. The lever 120 closes the clamp 118, which forces the main bus bar 104 against the branch bus bar 106.

In an embodiment, the clamp 118 is releasable, so the operator can actuate the lever 120 to open the clamp 118 when desirable to replace or move the tray 102 within the rack. In conventional server racks in which the branch bus bar 106 is bolted or riveted to the main bus bar 104, replacing or moving the tray 102 would require replacing the entire bus bar assembly 107, which is time intensive and costly. The clamping force exerted by the clamp 118 on the bus bars 104, 106 may also improve the electrical properties at the interface between the bus bars 104, 106 as compared to conventional connection means, such as by reducing contact resistance.

In the illustrated embodiment the branch bus bar 106 extends the entire distance from the tray 102 to the main bus bar 104. In an alternative embodiment, the branch bus bar 106 is shorter and only extends a portion of the distance from the main bus bar 104 to the tray 102. For example, in such an alternative embodiment, the branch bus bar 106 may be terminated to a distal end of an electrical cable or cable harness that extends from the tray 102 to the branch bus bar 106.

Figure 2:
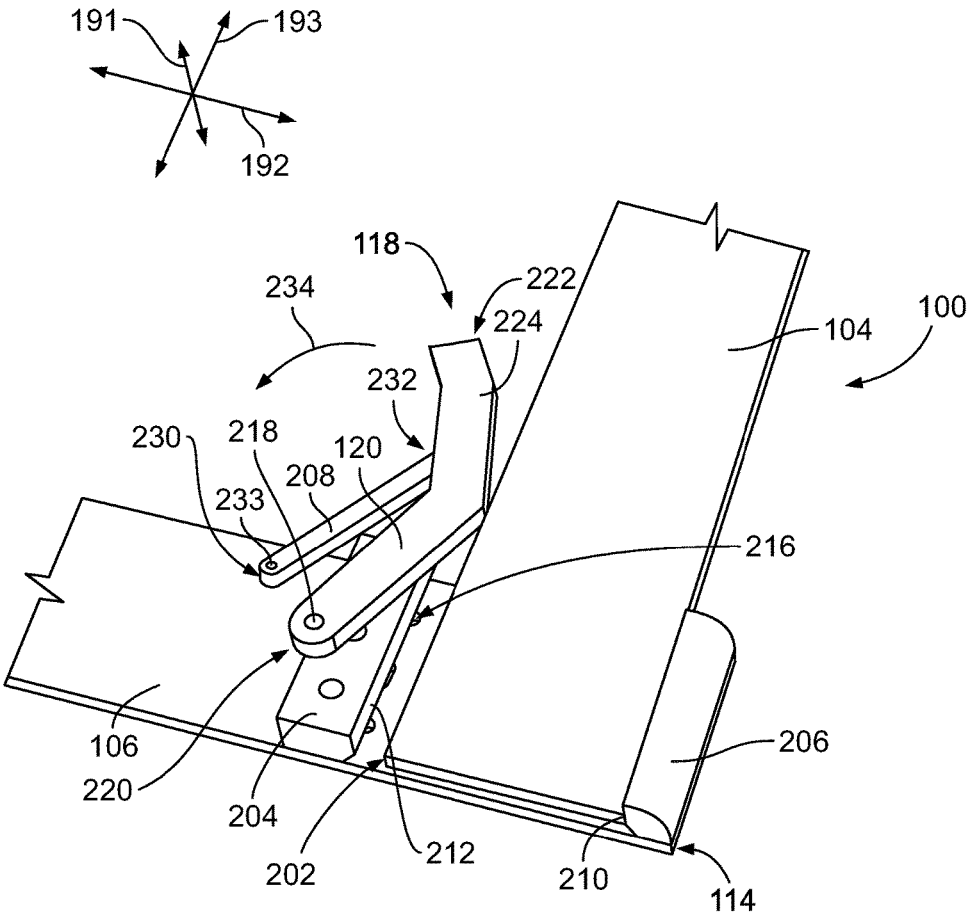
FIG. 2 is a top perspective view of a branch bus bar, a bus bar clamp, and a main bus bar of the electrical power distribution system according to an embodiment, shown with the bus bar clamp in an open position and the main bus bar disposed within a track of the bus bar clamp.

FIG. 2 is a top perspective view of a portion of the electrical power distribution system 100 according to an embodiment, shown with the bus bar clamp 118 of the branch bus bar 106 in an open position and the main bus bar 104 disposed within a track 202 of the clamp 118. The clamp 118 includes a movable plate 204, a fixed base 206, the lever 120, and a linkage 208. The track 202 of the clamp 118 is defined between the movable plate 204 and the fixed base 206. The fixed base 206 is secured to the branch bus bar 106, and does not move relative to the branch bus bar 106. The movable plate 204 is mounted to the branch bus bar 106 and is configured to reciprocally move towards and away from the fixed base 206. The main bus bar 104 within the track 202 of the clamp 118 is oriented transverse to the branch bus bar 106. For example, the main bus bar 104 may be perpendicular to the branch bus bar 106.

The clamp 118 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity or the surrounding environment.

The fixed base 206 and the movable plate 204 are both elongated longitudinally across at least most of a longitudinal width (e.g., parallel to the longitudinal axis 193) of the branch bus bar 106. A lateral width of the track 202 (e.g., parallel to the lateral axis 192) is defined between an inner side 210 of the fixed base 206 and an inner side 212 of the movable plate 204. The inner sides 210, 212 face each other across the track 202. The lateral width of the track 202 varies as the movable plate 204 is moved towards and away from the fixed base 206. For example, when the clamp 118 is in the open position, as shown in FIG. 2, the lateral width of the track 202 is greater than a lateral width of the main bus bar 104. In the open position, the clamp 118 does not retain the main bus bar 104, so the main bus bar 104 can enter the track 202 and exit the track 202.

The movable plate 204 may be mounted to the branch bus bar 106 via pins 215 (shown in FIG. 4) that extend through guide slots 216 in the branch bus bar 106. The guide slots 216 guide the movable plate 204 towards and away from the fixed base 206. The movable plate 204 is attached to the lever 120 via an axle 218.

The lever 120 extends between a mounting end 220 and an opposite, free end 222. The axle 218 is at or proximate to the mounting end 220. The lever 120 defines a handle 224 that extends to the free end 222. The handle 224 is configured to be manually grasped by an operator and/or engaged by a tool to pivot the lever 120 and actuate the clamp 118. The lever 120 is also pivotally connected to the linkage 208. The linkage 208 is pivotally connected to the branch bus bar 106 via a pin 233 at a bar end 230 of the linkage 208. A lever end 232 of the linkage 208, which is opposite to the bar end 230, is coupled to the lever 120 at a location along the lever 120 that is spaced apart from the mounting end 220 and the axle 218. For example, the lever end 232 of the linkage 208 may be pivotally connected or coupled to an intermediate section of the lever 120 at or proximate to the handle 224. As used herein, the terms "coupled" and "connected" are used interchangeably for secured mechanical engagement.

In an embodiment, the lever 120 is pivoted in a locking direction 234 to actuate the clamp 118 from the open position towards the closed position. The lever 120 pivots in the locking direction 234 within in a horizontal plane defined by the lateral and longitudinal axes 192, 193. As the lever 120 is pivoted in the locking direction 234, the lever 120 and the linkage 208 rotate about the pin 233 at the bar end 230 of the linkage 208, which defines a pivot point. The mounting end 220 of the lever 120 forces the movable plate 204 to translate linearly towards the fixed base 206, which reduces the lateral width of the track 202. As the width of the track 202 decreases, the main bus bar 104 is engaged by and secured between the inner sides 212, 210 of the movable plate 204 and the fixed base 206, respectively. One or both of the inner sides 210, 212 may be contoured to force the main bus bar 104 against the branch bus bar 106 as the inner sides 210, 212 sandwich the main bus bar 104.

Although the bus bar clamp 118 in the embodiments shown and described herein is mounted on the branch bus bar 106 and releasably couples to the main bus bar 104, in an alternative embodiment the bus bar clamp 118 may be mounted to the main bus bar 104 and releasably couples to the branch bus bar 106.

Figure 3:
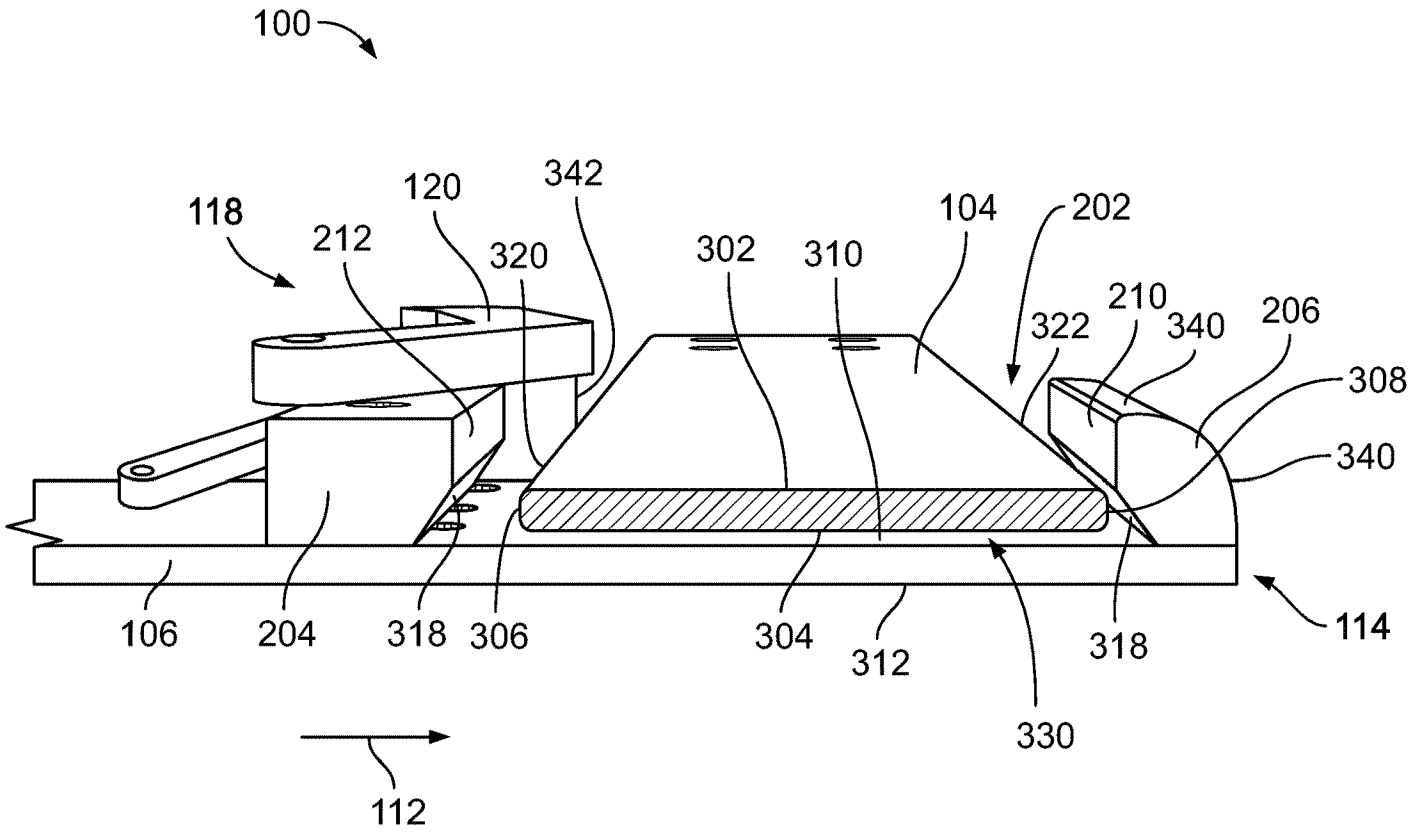
FIG. 3 is a side perspective view of the main bus bar in the bus bar clamp of the branch bus bar according to an embodiment.

FIG. 3 is a side perspective view of the main bus bar 104 in the bus bar clamp 118 of the branch bus bar 106 according to an embodiment. The clamp 118 is shown in the open position, as in FIG. 2. The main bus bar 104 is shown in cross-section, as the main bus bar 104 may extend beyond the branch bus bar 106 on one or both sides, depending on the location of the tray 102 (shown in FIG. 1) and the branch bus bar 106 relative to the main bus bar 104 and the rack.

In an embodiment, the main bus bar 104 is a flat metal sheet that includes a top broad face 302 and a bottom broad face 304 that is opposite to the top broad face 302. The main bus bar 104 includes first and second narrow edge sides 306, 308 that each extends between the broad faces 302, 304. As used herein, relative or spatial terms such as "front," "rear," "top," "bottom," "first," and "second," are only used to distinguish the referenced elements of the electrical power distribution system 100 and do not necessarily require particular positions or orientations relative to gravity and/or relative to the surrounding environment of the electrical power distribution system 100. The branch bus bar 106 is also a flat metal sheet that includes top and bottom broad faces 310, 312.

The bottom broad face 304 of the main bus bar 104 faces the top broad face 310 of the branch bus bar 106 within the track 202 of the clamp 118. The movable plate 204 and the fixed base 206 are disposed along the top broad face 310 of the branch bus bar 106. In an embodiment, at least one of the inner sides 210, 212 of the fixed base 206 and the movable plate 204 has a chamfered lower surface 318 that extends vertically from the respective inner side 210, 212 to the top broad face 310. In the illustrated embodiment, both inner sides 210, 212 include a chamfered lower surface 318. A lateral width of the track 202 between the chamfered lower surfaces 318 is greater than a lateral width of the track 202 vertically above the chamfered lower surfaces 318.

As the clamp 118 is closed to secure the main bus bar 104, the movable plate 204 moves linearly in the loading direction 112 relative to the branch bus bar 106 towards the fixed base 206. The inner side 212 of the movable plate 204 engages the first narrow side 306 of the main bus bar 104, and continued movement of the movable plate 204 forces the second narrow side 308 of the main bus bar 104 into engagement with the inner side 210 of the fixed base 206. More specifically, the main bus bar 104 is sandwiched between the chamfered lower surfaces 318 along the inner sides 210, 212. The chamfered lower surface 318 of the movable plate 204 engages the first narrow side 306 and may also engage an upper edge 320 of the main bus bar 104 at the intersection of the first narrow side 306 and the top broad face 302. The chamfered lower surface 318 of the fixed base 206 engages the second narrow side 308 and may also engage an upper edge 322 of the main bus bar 104 at the intersection of the second narrow side 308 and the top broad face 302. As additional force is applied by the lever 120 on the movable plate 204 towards the fixed base 206, the chamfered lower surfaces 318 re-direct that force in a downward direction, exerting a normal force that presses the upper edges 320, 322 of the main bus bar 104 downward against the branch bus bar 106. The bottom broad face 304 of the main bus bar 104 is pressed into engagement with the top broad face 310 of the branch bus bar 106 along a mating interface 330.

In an embodiment, the movable plate 204 and the fixed base 206 are composed of a conductive material, such as one or more metals, and therefore are electrically connected to the branch bus bar 106. Thus, when the main bus bar 104 is secured to the branch bus bar 106 via the clamp 118, there are three different contact areas through which electrical power (e.g., current) can be transmitted between the bus bars 104, 106. The first contact area is at the mating interface 330 between the bottom broad face 304 of the main bus bar 104 and the top broad face 310 of the branch bus bar 106. The second contact area is between the movable plate 204 and the first narrow side 306 of the main bus bar 104. Electrical current can be conveyed from the first narrow side 306 along the conductive movable plate 204 to the branch bus bar 106. The third contact area is between the fixed base 206 and the second narrow side 308 of the main bus bar 104, as electrical current can be conveyed along the conductive fixed base 206 from the second narrow side 308 to the branch bus bar 106. Conventional bus bar connections are established only along the mating interface 330, so the only electrical current transfer occurs along the bottom face 304 of the main bus bar 104, and there is no current transfer along the narrow sides 306, 308. In the illustrated embodiment, the additional contact areas provided by the engagement of the conductive clamp 118 on the narrow sides 306, 308 of the main bus bar 104 may result in lower contact resistance, and, therefore, improved electrical efficiency and reduced heat generation compared to the conventional bus bar connections.

In an alternative embodiment, the inner side 212 of the movable plate 204 includes the chamfered lower surface 318 or the inner side 210 of the fixed base 206 includes the chamfered lower surface 318, but not both. The single chamfered lower surface 318 provides a downward normal force that presses the two bus bars 104, 106 into engagement, as described above. The inner side 210, 212 that lacks the chamfered lower surface 318 may be planar, and engages the corresponding narrow side 306 or 308 of the main bus bar 104 along a larger contact area relative to the contact area defined between the chamfered lower surface 318 and the other narrow side 308 or 306.

The fixed base 206 in the illustrated embodiment has a curved outer surface 340 that slopes away from the rear end 114 of the branch bus bar 106 towards the inner side 210 of the fixed base 206. Optionally, the curved outer surface 340 of the fixed base 206 is configured to engage and at least partially deflect the branch bus bar 106 as the tray 102 (shown in FIG. 1) is loaded into the rack. For example, as the tray 102 and the branch bus bar 106 move in the loading direction 112, the outer surface 340 may abut against the first narrow side 306 of the main bus bar 104. Since the outer surface 340 is curved, the first narrow side 306 slides along the sloped outer surface 340 instead of stubbing, and one or both of the bus bars 104, 106 deflects away from the other. Once the inner side 210 of the fixed base 206 moves past the second narrow side 308 of the main bus bar 104, the deflected branch bus bar 106 resiles towards the main bus bar 104 causing the main bus bar 104 to be received into the track 202. Thus, the clamp 118 may be designed to allow for automatic receipt of the main bus bar 104 into the track 202 of the clamp 118 as the tray 102 is loaded into the rack.

Optionally, the clamp 118 may be configured such that the first narrow side 306 of the main bus bar 104 engages the lever 120 of the clamp 118 as the tray 102 (FIG. 1) is loaded into the rack. The movement of the tray 102 and the branch bus bar 106 relative to the main bus bar 104 causes the first narrow side 306 of the main bus bar 104 to engage a side 342 of the lever 120, forcing the lever 120 in the locking direction 234 (shown in FIG. 2). In an embodiment, when the tray 102 reaches the fully loaded position in the rack, the main bus bar 104 may have already automatically pivoted the lever 120 a substantial amount towards the closed position, such as about 50% or more of the lever 120 trajectory 234 towards the closed position. Therefore, once the tray 102 is mounted within the rack, the operator only has to manually move the lever 120 the remaining amount to close the clamp 118 and secure the main bus bar 104 to the branch bus bar 106. Thus, the clamp 118 optionally may be designed to include auto-closing.

Figure 4:
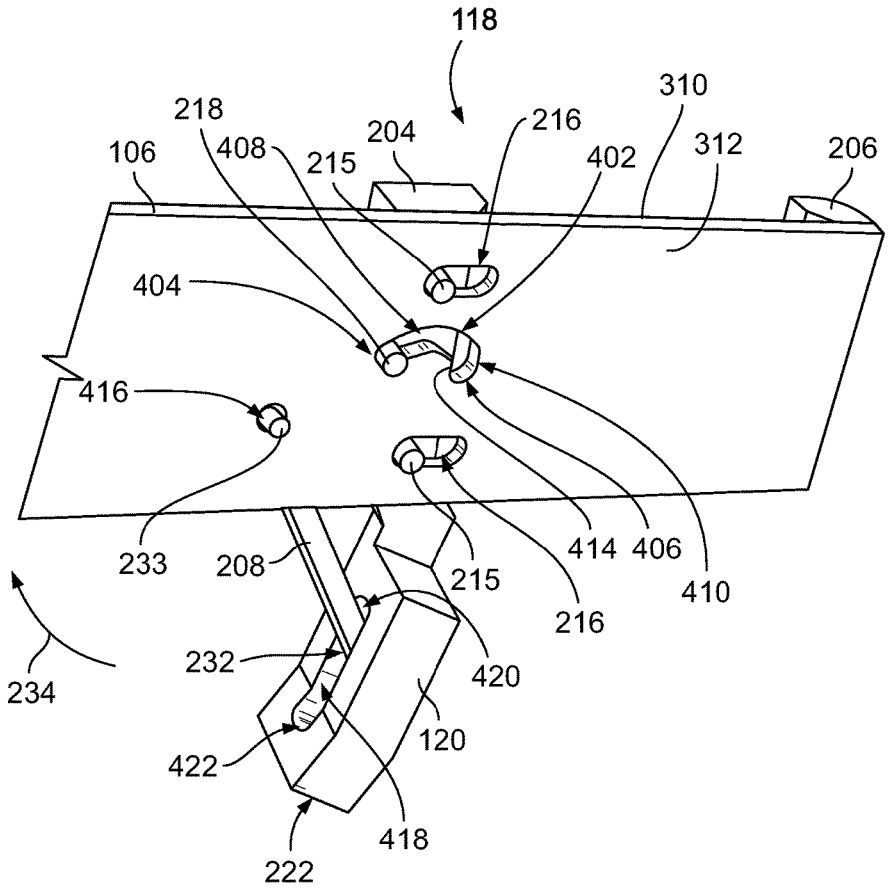
FIG. 4 is a bottom perspective view of the branch bus bar and the bus bar clamp of the electrical power distribution system according to an embodiment.

FIG. 4 is a bottom perspective view of the branch bus bar 106 and the clamp 118 of the electrical power distribution system 100 (shown in FIG. 1) according to an embodiment. The bottom broad side 312 of the branch bus bar 106 is shown while the clamp 118 is in the open position. The branch bus bar 106 defines multiple openings that extend through the branch bus bar 106 between the top and bottom broad sides 310, 312. For example, the branch bus bar 106 includes the two guide slots 216 that receive the pins 215 of the movable plate 204 therein. The guide slots 216 extend linearly along the lateral axis 192 (shown in FIG. 2). The guide slots 216 are configured to limit movement of the movable plate 204 to reciprocal movement along the lateral axis 192 (FIG. 2) towards and away from the fixed base 206.

The branch bus bar 106 also defines a locking slot 402 that receives the axle 218 connected to both the lever 120 and the movable plate 204. The locking slot 402 guides movement of the axle 218, which is the component that pushes and pulls the movable plate 204 as the lever 120 is pivoted. The locking slot 402 extends along a non-linear trajectory or path between a first end 404 and an opposite second end 406. The path of the locking slot 402 has a curved section 408 resembling the curve of a banana, and a linear detent 410 at the second end 406. For example, the banana-shaped curve 408 extends from the first end 404 to the detent 410, which extends from the curve 408 to the second end 406. The detent 410 is elongated longitudinally (e.g., perpendicular to the orientation of the guide slots 216). In an embodiment, when the lever 120 is rotated in the locking direction 234 towards the closed position to close the clamp 118, the axle 218 moves from the first end 404 along the curved section 408. When the lever 120 reaches the closed position, the axle 218 enters the detent 410, which locks the lever 120 in the closed position. For example, a shoulder 414 of the locking slot 402 within the detent 410 engages the axle 218, blocking the axle 218 from exiting the detent 410 and moving into the curved section 408 unless a threshold amount of force is exerted on the lever 120 in an unlocking direction that is opposite to the locking direction 234. The locking slot 402 is configured to prevent unintentional opening of the clamp 118.

The pin 233 through the bar end 230 (shown in FIG. 2) of the linkage 208 may extend through an aperture 416 in the branch bus bar 106. The aperture 416 is spaced apart laterally from the guide slots 216 and the locking slot 402. Optionally, the lever end 232 of the linkage 208 extends into an elongated channel 418 in the lever 120. The channel 418 may provide a track that allows the lever end 232 of the linkage 208 to translate relative to the lever 120 as the lever 120 is pivoted. For example, in the illustrated embodiment, the lever end 232 is disposed at a proximal end 420 of the channel 418, but the lever end 232 may slide to a distal end 422 of the channel 418 (e.g., opposite to the proximal end 420) when the lever 120 is pivoted to the closed position. The distal end 422 of the channel 418 is located closer to the free end 222 of the lever 120 than the proximity of the proximal end 420 of the channel 418 to the free end 222.

Figure 5:
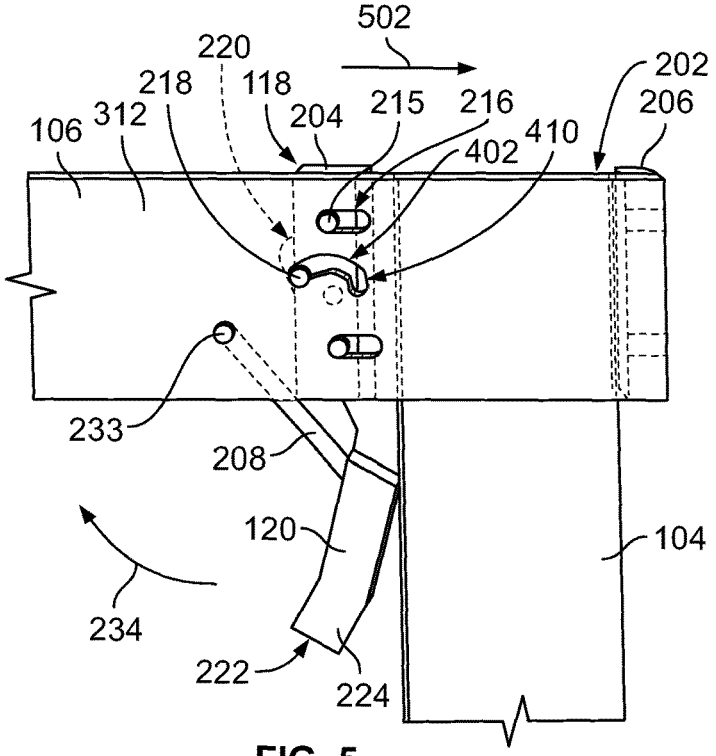
FIG. 5 is a bottom view of the bus bar clamp of the branch bus bar in the open position while the main bus bar is within the track of the bus bar clamp according to an embodiment.
Figure 6:
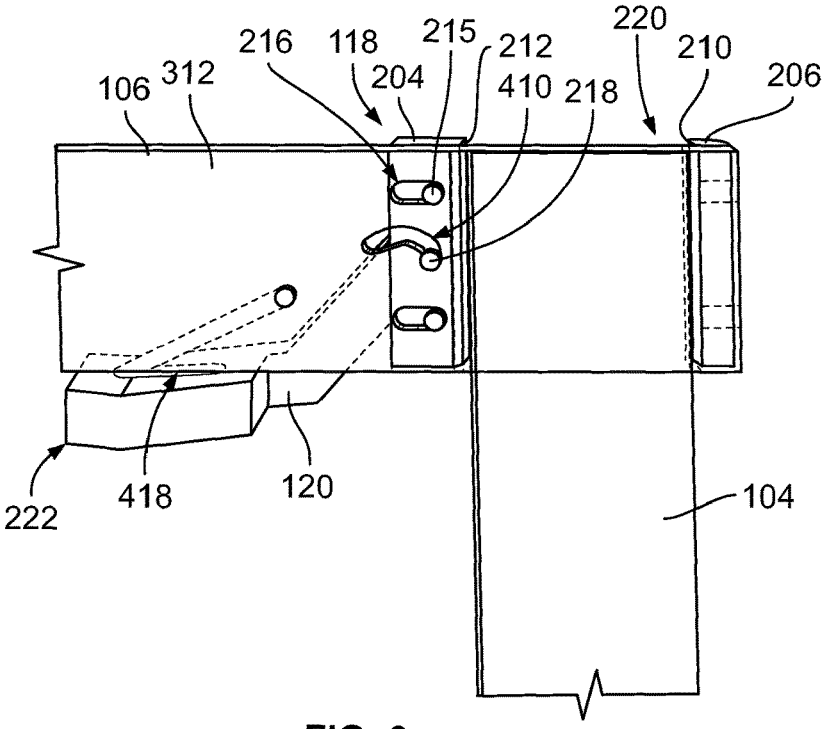
FIG. 6 is a bottom view of the bus bar clamp of FIG. 5 in the closed position, with the main bus bar secured to the branch bus bar in the track.

FIG. 5 is a bottom view of the clamp 118 of the branch bus bar 106 in the open position while the main bus bar 104 is within the track 202 of the clamp 118 according to an embodiment. FIG. 6 is a bottom view of the clamp 118 of FIG. 5 in the closed position, with the main bus bar 104 secured to the branch bus bar 106 in the track 202. In both FIGS. 5 and 6, the bottom broad face 312 of the branch bus bar 106 is shown, and the portions of the clamp 118 and the main bus bar 104 that are located behind the branch bus bar 106 are depicted in phantom.

To close the clamp 118 and secure the bus bars 104, 106 into locked engagement with each other, the handle 224 of the lever 120 is moved in the locking direction 234. The lever 120 pivots about the linkage 208 and the pin 233. For example, the linkage 208 pivots with the lever 120 about the pin 233. As described above with reference to FIG. 4, the linkage 208 may also move relative to the lever 120 within the channel 418. The pivoting of the lever 120 causes the mounting end 220 of the lever 120 to move the axle 218 through the locking slot 402 towards the detent 410. The axle 218 is also coupled to the movable plate 204, so the movement of the axle 218 through the locking slot 402 forces the movable plate 204 to move linearly, guided by the pins 215 in the guide slots 216, in a lateral closing direction 502 towards the fixed base 206. As the movable plate 204 moves towards the fixed base 206, the lateral width of the track 202 decreases. Eventually, the main bus bar 104 is sandwiched between the inner side 212 of the movable plate 204 and the inner side 210 of the fixed base 206. The lever 120 reaches the closed or locked position when the axle 218 is received within the detent 410 of the locking slot 402, as shown in FIG. 6. In the illustrated embodiment, the free end 222 of the lever 120 is located closer to the branch bus bar 106 in the closed position than in the open position.

Figure 7:
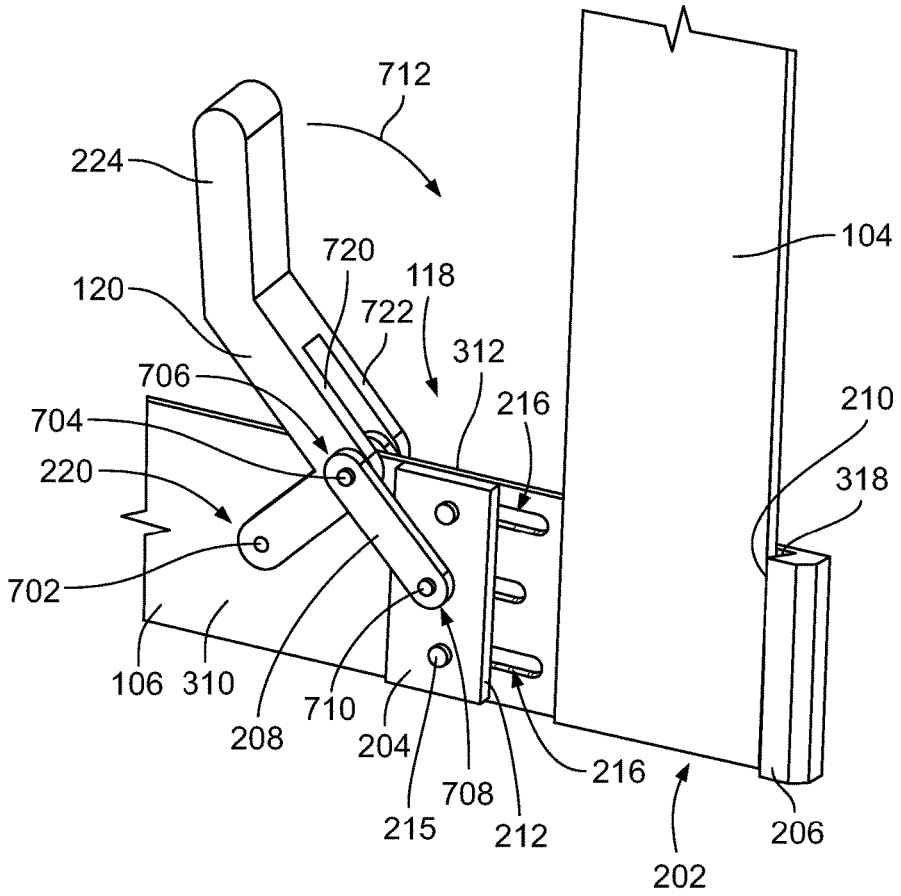
FIG. 7 is a perspective view of the bus bar clamp on the branch bus bar of the electrical power distribution system according to an alternative embodiment, with the bus bar clamp in the open position.
Figure 8:
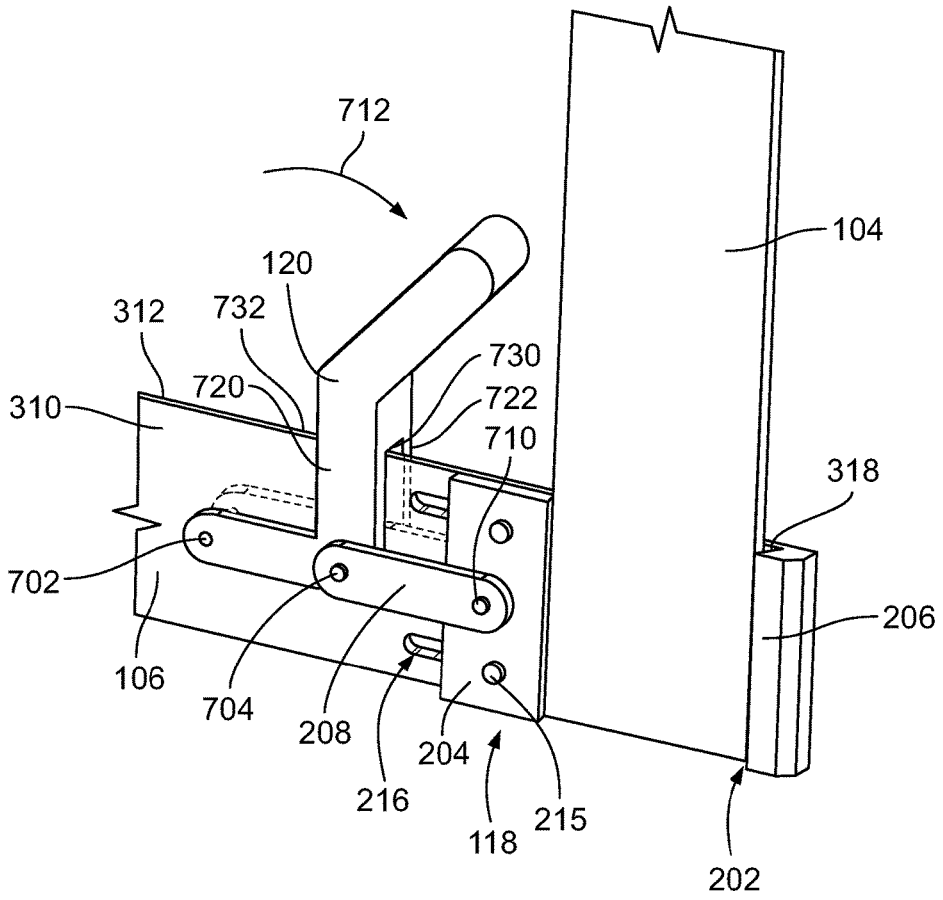
FIG. 8 is a perspective view of the bus bar clamp on the branch bus bar according to the embodiment shown in FIG. 7, with the bus bar clamp in the closed position.

FIG. 7 is a perspective view of the bus bar clamp 118 on the branch bus bar 106 of the electrical power distribution system 100 (shown in FIG. 1) according to an alternative embodiment. The clamp 118 is shown in the open position. FIG. 8 is a perspective view of the bus bar clamp 118 on the branch bus bar 106 according to the embodiment shown in FIG. 7, with the clamp 118 in the closed position. In both FIGS. 7 and 8, the main bus bar 104 is disposed within the track 202 of the clamp 118. In the illustrated embodiment, the fixed base 206 is the same or similar to the fixed base 206 of the embodiment shown in FIGS. 2-6, and the movable plate 204 is similar to the movable plate 204 shown in FIGS. 2-6. As opposed to the embodiment shown in FIG. 3, the inner side 212 of the movable plate 204 in FIG. 7 is planar and lacks a chamfered lower surface. However, the inner side 210 of the fixed base 206 has a chamfered lower surface 318 that is configured to direct a clamping force into a normal force that presses the main bus bar 104 into the branch bus bar 106.

The clamp 118 in the illustrated embodiment differs from the clamp 118 of the embodiment shown in FIGS. 2-6 in the mechanical connection between the lever 120, the linkage 208, the movable plate 204, and the branch bus bar 106. For example, the lever 120 in FIGS. 7 and 8 is indirectly coupled to the movable plate 204 via the linkage 208. Thus, the lever 120 is mechanically separate (e.g., spaced apart) from the movable plate 204 in FIGS. 7 and 8. The mounting end 220 of the lever 120 is pivotally coupled to the branch bus bar 106 via a pin 702 at a location that is spaced apart laterally from the movable plate 204. The pin 702 defines a pivot point upon which the lever 120 is rotated to actuate the clamp 118 from the open position shown in FIG. 7 to the closed position shown in FIG. 8. The lever 120 is pivotally coupled to one end 706 of the linkage 208 at a pin 704 that extends through the lever 120 at an intermediate location along a length of the lever 120 between the handle 224 and the mounting end 220. The opposite, second end 708 of the linkage 208 is pivotally coupled to the movable plate 204 via a pin 710 that extends through the movable plate 204.

In the illustrated embodiment, to close the clamp 118, an operator pushes the handle 224 of the lever 120 in a locking direction 712 to pivot the lever 120 about the pin 702. The rotation of the lever 120 causes the pin 704 attached to the lever 120 to move generally downward, which forces the linkage 208 to pivot. The movement of the linkage 208 causes the pin 710 at the second end 708 of the linkage 208 to push the movable plate 204 laterally, guided by the pins 215 within the guide slots 216, towards the fixed base 206 until the main bus bar 104 is clamped between the inner side 212 of the movable plate 204 and the chamfered lower surface 318 of the fixed base 206. In the illustrated embodiment, the handle 224 of the lever 120 moves toward the main bus bar 104 as the lever 120 is moved in the locking direction 712. In an alternative embodiment, the lever 120 may be configured to move in other directions to close the clamp 118. For example, the lever 120 is pivoted towards the branch bus bar 106 to close the clamp 118 in the embodiment shown in FIGS. 2-6.

Optionally, the lever 120 straddles the branch bus bar 106, such that a first leg 720 of the lever 120 extends along the top broad face 310 of the bus bar 106 and a second leg 722 of the lever 120 extends along the bottom broad face 312 of the bus bar 106. The pin 702 extends through the bus bar 106 and couples to both legs 720, 722. The linkage 208 is coupled to the first leg 720 of the lever 120. Although not shown, a second linkage 208 along the bottom broad face 312 of the branch bus bar 106 may be is connected to the second leg 722 of the lever 120.

The clamp 118 reaches the closed position when the lever 120 is pivoted to the illustrated position in FIG. 8. In the closed position, the linkage 208 is oriented horizontally and parallel to the orientation of the guide slots 216 that guide the reciprocating movement of the movable plate 204. The linkage 208 is collinear with a line extending between the pin 710 and the pin 702. The clamp 118 locks into the closed position because the linkage 208 and the portion of the lever 120 between the pin 704 and the pin 702 combine to form a rigid linkage that blocks movement of the movable plate 204 away from the fixed base 206. Optionally, the lever 120 may be designed such that a shoulder 730 of the lever 120 that extends between the two legs 720, 722 abuts against the narrow edge side 732 of the branch bus bar 106 to provide tactile feedback to an operator that the clamp 118 is in the closed position. The engagement between the shoulder 730 of the lever 120 and the branch bus bar 106 blocks additional movement of the lever 120 in the locking direction 712. Although not shown in FIGS. 7 and 8, the clamp 118 may include a detent that is configured to lock the movable plate 204 in the closed position, similar to the detent 410 in the locking slot 402 shown in FIG. 4.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical power distribution system comprising:

a first bus bar having a broad face; and a clamp mounted to the first bus bar, the clamp including a fixed base and a movable plate that define a track along the broad face between an inner side of the fixed base and an inner side of the movable plate, the track configured to receive a second bus bar therein such that the broad face of the first bus bar engages a corresponding broad face of the second bus bar, the clamp including a lever connected to both the movable plate and the first bus bar, wherein pivoting movement of the lever in a locking direction forces linear movement of the movable plate relative to the first bus bar towards the fixed base such that the inner sides of the movable plate and the fixed base sandwich the second bus bar therebetween to secure the second bus bar in engagement with the first bus bar.

2. The electrical power distribution system of claim 1, wherein the inner side of at least one of the fixed base or the movable plate has a chamfered lower surface that is angled towards the broad face of the first bus bar.

3. The electrical power distribution system of claim 1, wherein the track of the clamp is configured to receive the second bus bar in an orientation that is transverse to an orientation of the first bus bar.

4. The electrical power distribution system of claim 1, wherein the lever is connected to the movable plate via an axle, and the lever is connected to the first bus bar via a linkage.

5. The electrical power distribution system of claim 4, wherein the linkage is a linear member having a bar end that is pivotally connected to the first bus bar and a lever end opposite the bar end that is pivotally connected to the lever.

6. The electrical power distribution system of claim 4, wherein the first bus bar defines a locking slot that extends along a non-linear trajectory from a first end of the locking slot to a second end of the locking slot, wherein the axle connecting the lever to the movable plate is disposed within the locking slot and moves along the non-linear trajectory as the lever is pivoted.

7. The electrical power distribution system of claim 1, wherein the lever is connected to the first bus bar via a pin that is spaced apart from the movable plate, and the lever is connected to the movable plate via a linkage, the linkage having a first end pivotally connected to the lever and a second end opposite the first end that is pivotally connected to the movable plate.

8. The electrical power distribution system of claim 1, wherein the inner sides of the fixed base and the movable plate of the clamp engage corresponding first and second edge sides of the second bus bar, wherein the fixed base and the movable plate are electrically conductive and provide respective electrically conductive paths between the first and second edge sides of the second bus bar and the first bus bar.

9. The electrical power distribution system of claim 1, wherein the first bus bar defines linear guide slots that extend parallel to each other, the movable plate including pins that extend into the guide slots, wherein the movable plate is linearly movable relative to the first bus bar based on positions of the pins within the guide slots.

10. The electrical power distribution system of claim 1, wherein the lever extends from a mounting end of the lever to a free end of the lever, the lever including a handle that extends to the free end, the mounting end pivotally connected to one of the first bus bar or the movable plate.

11. The electrical power distribution system of claim 1, wherein the broad face of the first bus bar is a top broad face and the first bus bar includes a bottom broad face opposite the top broad face, wherein the lever has first and second legs that straddle the first bus bar such that the first leg extends along the top broad face and the second leg extends along the bottom broad face.

12. An electrical power distribution system comprising:

a first bus bar having a broad face;

a clamp mounted to the first bus bar, the clamp including a fixed base and a movable plate that define a track along the broad face between an inner side of the fixed base and an inner side of the movable plate, the clamp including a lever connected to both the movable plate and the first bus bar; and a second bus bar having a broad face and first and second edge sides extending from the broad face, the second bus bar received in the track with the broad face thereof engaging the broad face of the first bus bar at an interface;

wherein pivoting movement of the lever in a locking direction forces linear movement of the movable plate relative to the first bus bar towards the second bus bar in the track such that the inner side of the movable plate engages the first edge side of the second bus bar and the inner side of the fixed base engages the second edge side of the second bus bar to secure the second bus bar in engagement with the first bus bar at the interface.

13. The electrical power distribution system of claim 12, wherein the second bus bar within the track of the clamp is oriented transverse to an orientation of the first bus bar.

14. The electrical power distribution system of claim 12, wherein the inner side of at least one of the fixed base or the movable plate has a chamfered lower surface that is angled towards the broad face of the first bus bar, the chamfered lower surface forcing the second bus bar into the broad face of the first bus bar as the lever is moved in the locking direction.

15. The electrical power distribution system of claim 12, wherein the fixed base and the movable plate are electrically conductive and provide respective electrically conductive paths between the first and second edge sides of the second bus bar and the first bus bar.

16. The electrical power distribution system of claim 12, wherein the clamp further includes a linkage having a first end pivotally connected to the lever and a second end opposite the first end pivotally connected to one of the movable plate or the first bus bar.

17. An electrical power distribution system comprising:

a first bus bar having a broad face and defining linear guide slots therethrough that extend parallel to one another; and a clamp mounted to the first bus bar, the clamp including a fixed base and a movable plate that are electrically conductive, the movable plate including pins that extend into the guide slots, the fixed base and the movable plate defining a track along the broad face between an inner side of the fixed base and an inner side of the movable plate, the track configured to receive a second bus bar therein such that the broad face of the first bus bar engages a corresponding broad face of the second bus bar, the clamp including a lever connected to both the movable plate and the first bus bar, wherein pivoting movement of the lever in a locking direction forces linear movement of the movable plate towards the fixed base guided by the pins within the guide slots of the first bus bar, wherein the linear movement of the movable plate causes the inner sides of the movable plate and the fixed base to engage respective first and second edge sides of the second bus bar to secure the broad face of the second bus bar in engagement with the broad face of the first bus bar, wherein the fixed base and the movable plate provide respective electrically conductive paths between the first and second edge sides of the second bus bar and the first bus bar.

18. The electrical power distribution system of claim 17, wherein the inner side of at least one of the fixed base or the movable plate has a chamfered lower surface that is angled towards the broad face of the first bus bar, the chamfered lower surface forcing the second bus bar into the broad face of the first bus bar as the lever is moved in the locking direction.

19. The electrical power distribution system of claim 17, wherein the lever is connected to the movable plate via an axle, and the lever is connected to the first bus bar via a linkage, the linkage having a bar end that is pivotally connected to the first bus bar and a lever end opposite the bar end that is pivotally connected to the lever.

20. The electrical power distribution system of claim 17, wherein the lever is connected to the first bus bar via a pin that is spaced apart from the movable plate, and the lever is connected to the movable plate via a linkage, the linkage having a first end pivotally connected to the lever and a second end opposite the first end that is pivotally connected to the movable plate.

* * * * *